United States Patent [19]

Kratfel

[11] Patent Number: 4,785,586

[45] Date of Patent: Nov. 22, 1988

[54] CUE TIP SHAPING DEVICE

[76] Inventor: Edward R. Kratfel, 8800 Y Kelso Dr., Baltimore, Md. 21221

[21] Appl. No.: 24,130

[22] Filed: Mar. 11, 1987

[51] Int. Cl.[4] ..... B24B 25/00

[52] U.S. Cl. ..... 51/181 R; 51/204; 51/205 R; 51/211 R; 30/494; 273/17

[58] Field of Search ..... 30/494; 273/17–21; 72/409, 410; 51/204, 205 R, 205 WG, 211 R, 214, 181 R; 29/89.5, 90 R

[56] References Cited

U.S. PATENT DOCUMENTS

| | | | |
|---|---|---|---|
| 345,031 | 7/1886 | Couch | 7/124 |
| 451,938 | 5/1891 | Klapperich | 273/20 |
| 965,444 | 7/1910 | Dahl | 723/18 |
| 4,247,374 | 1/1981 | Roscoe et al. | 72/359 |

*Primary Examiner*—Frederick R. Schmidt
*Assistant Examiner*—Maurina Rachuba
*Attorney, Agent, or Firm*—Armstrong, Nikaido, Marmelstein & Kubovcik

[57] ABSTRACT

Device for shaping a cue stick tip, including a body, a scuffer mounted at one end of the body and a coiner mounted at the other end of the body. The scuffer is for rough cutting the tip, especially a new tip or badly worn tip, to impart a desired overall shape to the tip, and the coiner reforms the tip which has been distorted and dimpled as a result of repeated cue tip-ball contact to remove the dimples and impart a smooth and uniform exterior contour to the tip.

17 Claims, 1 Drawing Sheet

CUE TIP SHAPING DEVICE

The present invention relates to a device for shaping a cue stick tip.

BACKGROUND OF THE INVENTION

The following patents relate to devices for shaping cue stick tips.

U.S. Pat. No. 221,164 describes a billiard-cue chalk block having sand paper secured to the bottom and sides of the block. The top surface of the chalk is formed with a concavity adapted to fit the tip of the cue, and the sandpaper at the bottom may also be formed with a similar depression for occasional use.

U.S. Pat. No. 284,548 describes a billiard cue trimmer comprising a block with a series of chambers, each having a concave bottom covered with sandpaper or emery cloth. The curvature of each bottom is graduated in accordance with a fixed standard, and the scale of curvature is indicated by an appropriate symbol so that a cue tip can be trimmed to any convex contour desired by a player.

U.S. Pat. No. 1,259,136 describes a device for trimming billiard cue tips including a receptacle having a bottom and an annular wall. A disc-like abrading surface is provided at the bottom of the receptacle, and the annular wall is notched or serrated to form a file-like surface to engage the edge of the cue tip.

U.S. Pat. No. 3,728,828 describes a cue tip trimmer which is an abrasive wheel, shaped to easily trim cue stick tips and refinish them as they are worn during play. The trimmer consists of a solid cylindrically shaped abrasive wheel having a cylindrical recess which terminates within the wheel in a concave shape recess.

A need exists for a device which will enable a player of a table ball game, such as pool, snooker or billiards, to reform the tip of the cue stick which has become dimpled or distorted due to repeated cue tip-ball contacts so that the tip is maintained with a smooth, uniform exterior contour. The exterior contour of the tip changes constantly during a pool game as a result of the repeated cue-ball contacts. These variations in the external contour of the tip adversely affect the accuracy of a shot, since the cue ball upon being struck by the distorted tip will likely not roll in the particular desired direction. To date, the usual method by which players compensate for the changes in the exterior contour of the tip is by "chalking" the tip. However, chalking does not reform the tip which has been deformed in tip cue-ball contact, but merely aids in increasing friction between the cue stick tip and the cue ball. Thus, a need exists for a tool which will enable a player to eliminate the variations in tip form, including contour, smoothness, tip density and uniform surface.

SUMMARY OF THE INVENTION

According to one aspect of the present invention, there is provided a device for shaping a cue stick tip comprising a body, a scuffing means mounted in said body for rough cutting the cue stick tip to impart a desired overall shape to the tip. A tip reforming means is also mounted in the body for imparting a uniform exterior contour to the tip.

According to another aspect of the present invention, there is provided a device for shaping a cue stick tip, comprising a body having a tip reforming means mounted in the body for imparting a uniform exterior contour to the tip.

According to a further aspect of the present invention, there is provided a device for shaping a cue stick tip, comprising a body, a chalking means mounted within in the body for applying chalk to the tip, and a tip reforming means mounted in the body for imparting a smooth and uniform exterior contour to the tip.

BRIEF DESCRIPTION OF THE DRAWINGS

Embodiment of the invention will now be described in more detail, with reference to the accompanying drawings, in which.

DETAILED DESCRIPTION OF THE INVENTION

Figure 1:
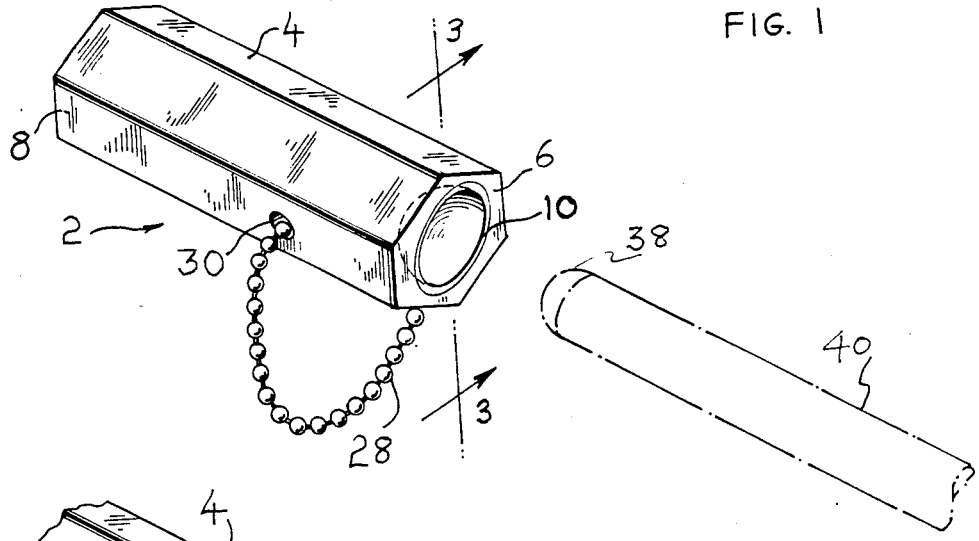
FIG. 1 is a perspective view of the device of the invention showing a tip reforming means mounted in one end of the device and about to receive a cue stick tip.

Referring to FIG. 1, the device of the invention, generally referenced 2, comprises a body 4 having ends 6 and 8. At end 6 there is provided a tip reformer 10, and at end 8 there is provided a scuffer 12 (see FIG. 2).

Figure 2:
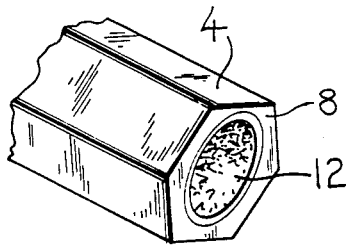
FIG. 2 is a perspective view of the other end of the device of FIG. 1 showing the scuffing means.

The body 4 is comprised of an elongate member having a cross-sectional configuration such that the device does not roll on a flat surface. The device illustrated in FIGS. 1 and 2 is hexagonal in cross-section, but this cross-sectional configuration is not critical, and the device could equally well be triangular, or polygonal in cross-section, to reduce the tendency of the device rolling on a flat surface.

The body 4 may be fabricated from any suitable material, such as metal or a non-metal or plastics material. According to a preferred embodiment, the device is fabricated from hexagonal aluminum solid stock that can be of various colors. However, the device could equally well be fabricated from a plastics material, which might be transparent or colored with any desired color. The provision of one or more flat faces on he body 4 has the advantage that the owner's name serial number or initials can be readily inscribed on the device, thereby providing a ready means of associating the device with its owner.

The tip reformer 10 is mounted in the end 6 of the device. The tip reformer 10 is preferably fabricated from solid cylindrical stainless steel stock 14 or stamped and chrome plated and comprises a hemispherical highly polished concavity 16 formed in the end of the stock 14. The concavity 16 is shaped so as to enable the tip of the cue to be repeatedly reformed with a uniformly smooth exterior contour. The stock 14 is fixedly received in a corresponding cylindrical aperture 18 formed in the end of the body. The stock 14 is mounted in the aperture by any suitable method, such as by a frictional press fit or by the use of a suitable adhesive.

The scuffer 12 is provided at the end 8 of the device. The scuffer 12 is preferably formed from stainless steel cylindrical solid stock 20 or stamped and includes a hemispherical concavity 22 having sharp protrusions 24 formed on the concave surface of the concavity 22. The sharp protrusions 24 may be formed of any suitable abrasive material, for example silicon carbide chips which are silver brazed onto the concave surface of the concavity 22. As with the stock 14, th stock 20 is fixedly received in a cylindrical aperture 26 formed in the end 8 of the body 4. The stock 20 may be mounted in the cylindrical aperture 26 using the same means as for the stock 14, for example by frictional press fit or by the use of an appropriate adhesive.

Figure 3:
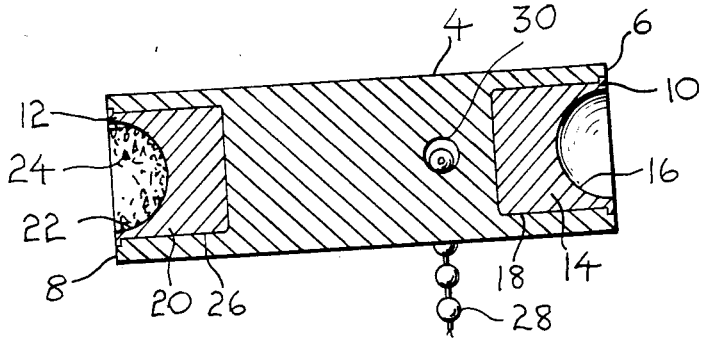
FIG. 3 is a cross-sectional side view taken along the line 3—3 in FIG. 1.

In order to assist the user in carrying the device, a carrying means such as a chain 28 is provided which extends through an aperture 30 in the body 4. As can be seen from FIG. 3, the aperture 30 is disposed nearer the end 6 than the end 8 so that the device 4 is counterbalanced downward when held by the chain 28.

Figure 4:
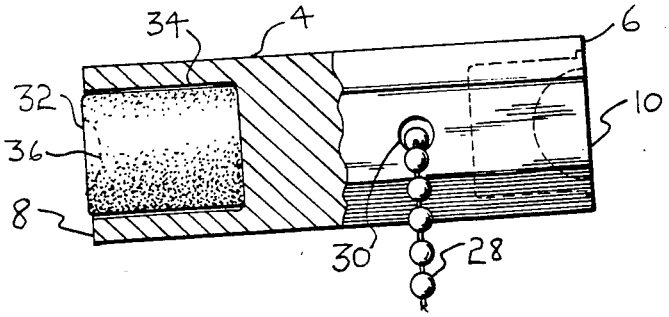
FIG. 4 is a partial cross-sectional view of another embodiment of the invention having a tip reforming means at one end and a chalk insert at the other end.

FIG. 4 shows an alternative embodiment of the device of the invention wherein the scuffer 12 is replaced by a chalk insert 32. The chalk insert 32 is received within an appropriately shaped cavity 34 in the end of the body 4. The chalk insert 32 is preferably press fitted into the cavity 34 so that when the chalk has been worn down and a new insert is required, it is a simple matter to remove residual chalk from the aperture 34 using a scraper or the like. the chalk insert 32 may optionally be provided at the exposed end with a concavity 36 in order to facilitate uniform application of chalk to the cue tip.

As is well known, cue tip chalk is readily available in the form of cubicular blocks, and players more often than not will possess their own preferred chalk blocks. In view of this, another embodiment of the invention, provides a device having only a tip reformer 10 at the end 6, with the other end 8 being free of a scuffer or chalk insert. Such an embodiment would appear as that shown in FIG. 1.

In use of the device, cue tip 38 of cue stick 40 is reformed by placing the tip 38, typically having a leather outer covering, into the concavity 16 and manually applying pressure and a rotating movement of the concavity about the tip 38. This serves to reform the tip and eliminate dimples and other variations in the tip form, and imparts to the tip the desired smoothness, contour, density and uniformity of surface without abrading or otherwise wearing the tip away. The tip reformer is designed to be used by the player frequently during the game since the tip is quickly dimpled and deformed by repeated tip cue-ball contacts, thereby increasing the likelihood of inaccurate shots.

When the tip has become badly deformed or worn, or when the cue stick 40 is provided with a new tip 38, the scuffer is used to coarsely abrade the tip to the approximate desired shape. New or replaced tips are cylindrical in shape, and are handformed by various means to the desired shape. The desired shape of cue tip varies greatly from player to player, and the scuffer enables the desired external tip configuration to be quickly and easily achieved. After scuffing has been completed, the final proper tip configuration can be readily obtained by use of the tip reformer as described above. Chalking the tip after reforming then puts the tip in good condition for playing.

The present invention provides a cue tip device which substantially if not completely eliminates variations in tip configuration, and enables the player to repeatedly obtain a uniformity of tip contour, surface smoothness and tip density. These factors all contribute to whether the cue tip gives rise to an accurate shot upon contact with the cue ball, since changes in any one of the above factors will adversely affect the performance and repeatability of a player's shot.

I claim:

1. A device for shaping a cue stick tip, said device comprising:

a body;

a scuffing means mounted on said body for rough cutting said cue stick tip to impart a desired overall shape to said tip;

a tip reforming means mounted on said body and comprising a smooth, polished, non-abrasive concave surface of correct shape for repeatedly reforming the exterior contour of said tip.

2. A device according to claim 1, wherein said body is an elongate member having first and second ends, said scuffing means being provided at said first end and said tip reforming means being provided at said second end.

3. A device according to claim 2, wherein said body is polygonal in cross-section.

4. A device according to claim 3, wherein said body is hexagonal in cross-section.

5. A device according to claim 1, wherein said scuffing means comprises an approximately hemispherical concave surface having abrading means on said surface for cutting said cue tip.

6. A device according to claim 5, wherein said abrading means comprises silicon carbide chips brazed to said concave surface.

7. A device according to claim 5, wherein said abrading means comprises stamped sharp peaks.

8. A device according to claim 1, wherein said tip reforming means comprises a highly polished metal concavity.

9. A device according to claim 1, wherein said body is provided with carrying means for carrying said device.

10. A device according to claim 9, wherein said carrying means comprises a chain extending through an aperture in said body.

11. A device according to claim 1, wherein said body is fabricated from metal.

12. A device according to claim 11, wherein said metal is anodized aluminum.

13. A device according to claim 1 wherein said body is fabricated from a plastics material.

14. A device according to claim 13, wherein said body is transparent.

15. A device according to claim 13, wherein said body is colored.

16. A device for shaping a cue stick tip, said device comprising:

an elongate body having a hexagonal cross-section, said body having first and second ends;

a scuffing means mounted on said first end of said body for cutting said cue stick tip to impart a desired overall external contour to said tip;

a tip reforming means mounted in said second end and comprising a smooth, polished, non-abrasive concave surface of correct shape for repeatedly reforming the external contour of said tip.

17. A device for shaping a cue stick tip, said device comprising:

a body;

a chalking means mounted on said body for applying chalk to said tip;

a tip reforming means mounted on said body and comprising a smooth, polished, non-abrasive concave surface of correct shape for repeatedly reforming the exterior contour of said tip.

* * * * *